US005308230A

United States Patent [19]

Moore

[11] Patent Number: 5,308,230

[45] Date of Patent: May 3, 1994

[54] BELLOWS PUMP

[75] Inventor: Arthur L. Moore, Canyon Country, Calif.

[73] Assignee: Stainless Steel Products, Inc., Burbank, Calif.

[21] Appl. No.: 27,662

[22] Filed: Mar. 8, 1993

[51] Int. Cl.[5] ..... F04B 43/10

[52] U.S. Cl. ..... 417/394; 417/473

[58] Field of Search ..... 417/63, 394, 473, 399; 92/37

[56] References Cited

U.S. PATENT DOCUMENTS

| | | | |
|---|---|---|---|
| 3,182,597 | 5/1965 | Malizard | 417/473 |
| 3,473,347 | 10/1969 | Andrews | 417/473 |
| 3,597,120 | 8/1971 | Reed | 417/394 |
| 4,488,592 | 12/1984 | Mittal | 165/104 |
| 4,585,397 | 4/1986 | Crawford et al. | 417/63 X |
| 4,618,425 | 10/1986 | Yates | 210/416 |
| 4,655,690 | 4/1987 | Boedecker et al. | 417/53 |
| 4,718,836 | 1/1988 | Pottier et al. | 92/37 X |
| 4,718,893 | 1/1988 | Dorman et al. | 417/473 |
| 4,732,549 | 3/1988 | Von Schuckmann | 417/472 |
| 4,836,756 | 6/1989 | Fukumoto | 417/394 |
| 4,902,206 | 2/1990 | Nakazawa | 417/394 |
| 4,981,418 | 1/1991 | Kingsford et al. | 417/63 X |
| 5,141,412 | 8/1992 | Meinz | 417/473 |
| 5,195,878 | 3/1993 | Sahiavo et al. | 417/473 X |

*Primary Examiner*—Richard A. Bertsch
*Assistant Examiner*—Alfred Basichas
*Attorney, Agent, or Firm*—Harlan P. Huebner

[57] ABSTRACT

A metallic bellows pumps for pumping corrosive, caustic, acidic or toxic fluids which includes a casing with an annular bellows portion within said casing with one end affixed to the casing and the other secured to a piston closure plate with the plate and bellows being moveable toward and away from the fixed end to receive and discharge a fluid with reciprocating movement of the bellows within the casing, and power means to activate and control the movement of the bellows within the bellows pump.

14 Claims, 4 Drawing Sheets

BELLOWS PUMP

BACKGROUND OF THE INVENTION

1. Field of the Invention

This invention relates to a metallic bellows pump that among other things is adapted to pump metered fluids.

2. Description of the Prior Art

In the pumping of some fluids particularly those that are corrosive, caustic, acidic or toxic previous piston or diaphragm pumps used to meter the fluid have employed O rings and seals of composition material that are attacked by the fluids and will be eaten away causing leaks and in some cases malfunctions.

Further, with the deteriation of prior art pumps seals, etc. unwanted leakage of the corrosive, caustic, acidic or toxic fluid occurs and can not only cause further injury to the pumps but can cause damage to the areas surrounding the pumps.

Also some of the prior art pumps cannot withstand high pressures that may be necessary when pumping fluids.

In addition, some prior art pumps that are utilized for metering, be it slow or rapid metering, have failed to maintain the proper tolerances necessary.

Finally, with the deterioration of prior art pumps or seals therein unnecessary maintenance is required.

SUMMARY OF THE INVENTION

It is an object of the present invention to provide a metallic bellows pump without exposed seals that are subject to attack by corrosive, caustic, acidic or toxic fluids during pumping of the fluid.

Another object of the present invention is to provide a metallic bellows pump that may be a single bellows or dual bellows to accomplish the proper pumping of a fluid.

A still further object of the present invention is to provide a metallic bellows pump that will not leak during operation due to damage that could be caused by the fluid being pumped.

A yet further object of the present invention is to provide a metallic bellows pump that is adapted to act as a metering pump to either pump a relatively small quantity of fluid at lengthy intervals to a relatively large quantity of fluid at short intervals.

Another object of the present invention is to provide a metallic bellows that can withstand high pressures during operation due to the lack of composite material seals in the pump fluid flow stream.

A still further object of the invention is to provide a metallic bellows pump that can be adapted to pump natural gas which in the past has broken down lubricants of conventional pumps causing malfunctions. In the present pump the need for lubricants on parts in the fluid flow stream is unnecessary.

These and other objects and advantages will become apparent from the following part of the specification wherein details have been described for the competence of disclosure, without intending to limit the scope of the invention which is setforth in the appended claims.

BRIEF DESCRIPTION OF THE DRAWINGS

These advantages may be more clearly understood from the following detailed description and by reference to the drawings in which.

DETAILED DESCRIPTION OF THE PREFERRED EMBODIMENT

Figure 1:
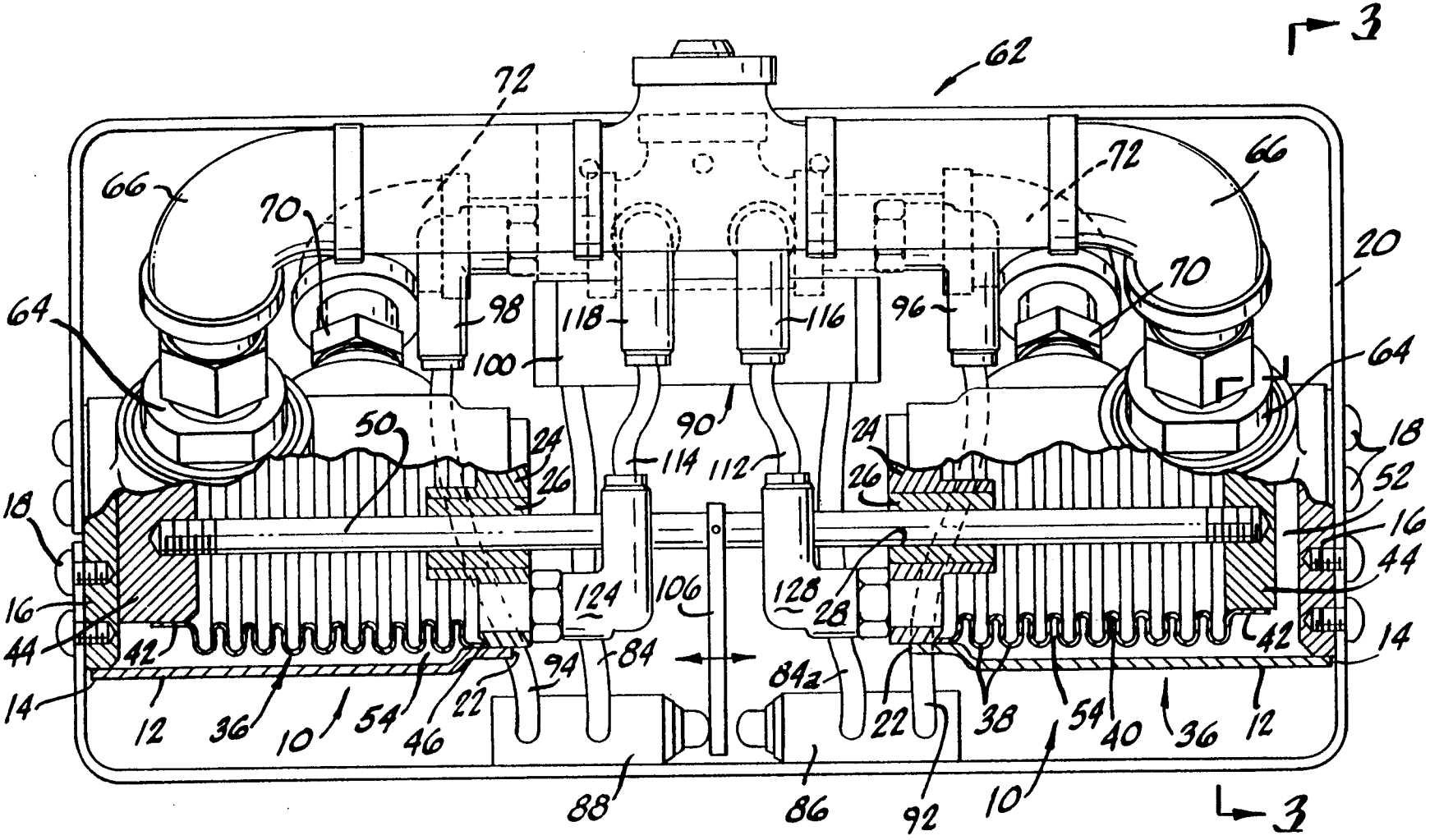
FIG. 1 is a side elevational view of a pair of metallic bellows pumps and other apparatus wherein the pumps may operate showing the bellows shifted to the left.

In FIG. 1 these is illustrated a pair of reciprocating metallic bellows pumps designated 10. Each pump 10 includes an outer annular metallic cover or casing 12.

Figure 2:
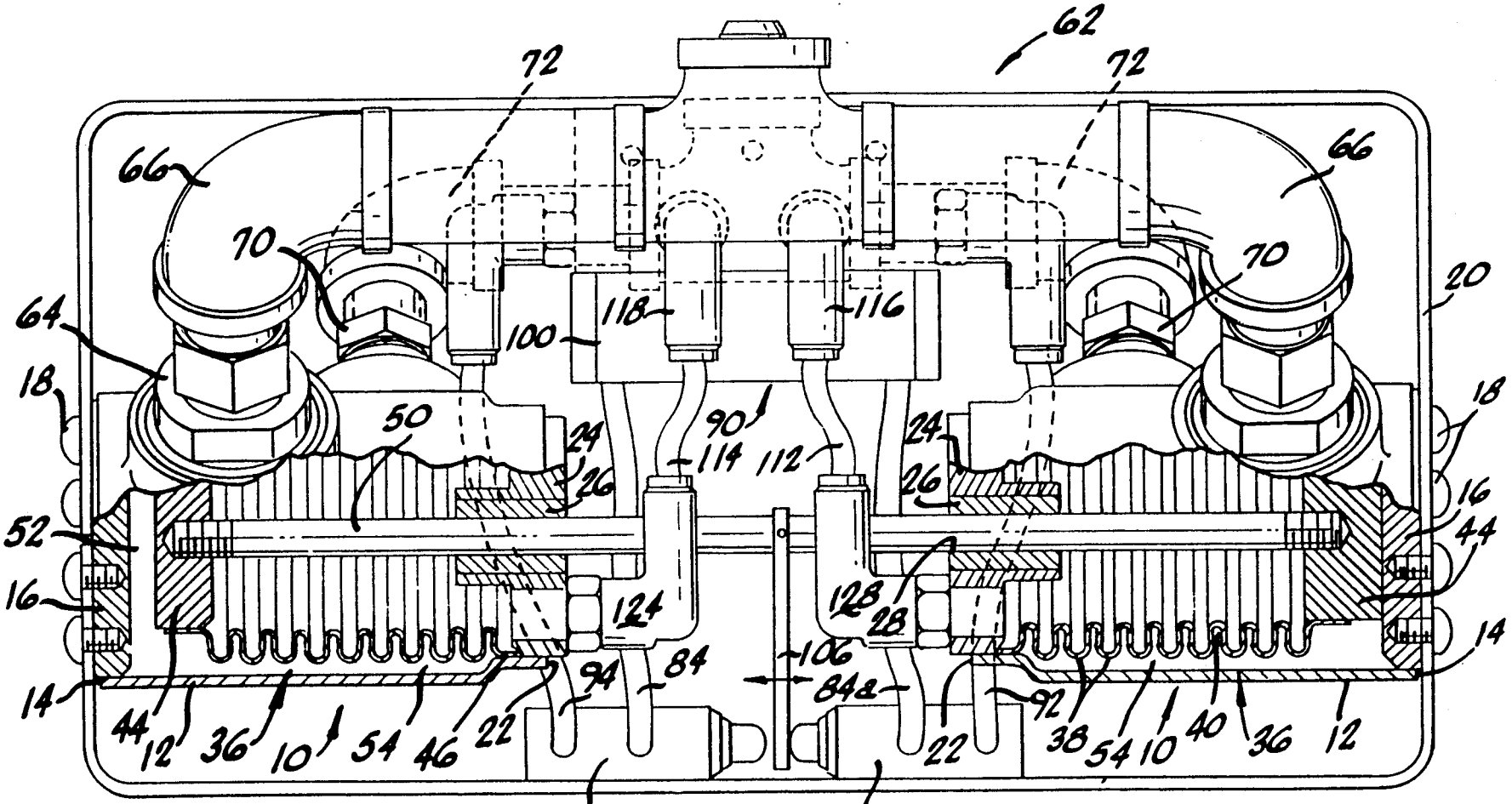
FIG. 2 is view similar to FIG. 1 with the twin bellows of this form shifted to the right.

At the outer end 14 of each casing 12 there is an annular metallic end closure plate 16 that is forced or wedged into the casing 12 to close off the pump. The plates 16 may also be affixed to the casing 12 by conventional welding. In the illustrations of FIGS. 1 and 2 the end plates 16 are secured by bolts 18 to a mounting frame 20. This mounting supports the pumps 10 as they are suspended inwardly from the frame 20.

The inner end 22 of the casing 10 also includes an annular metallic inner end closure plate or plug 24. Mounted within each plug 24 is an annular bearing 26 with a horizontal bore 28 passing therethrough.

Mounted within each casing 12 is an annular metallic bellows designated 36. The bellows 36 each include a number of annular convolutions 38 one jointed to the next by an inwardly recessed web portion 40. Due to the construction of the bellows 10 and the thickness of the metal used to form the convolutions 38 and connecting webs 40 the bellows each are resilient and flexible and may be contracted and expanded on a horizontal plane.

Each of the bellows 36 at outer end 42 is fitted with a metallic piston closure plate 44.

The inner end 46 of the bellows 36 is positioned within the end 22 of the casing 12 and clamped in place by the annular inner end closure plate 24. Thus, there is present a hollow closed bellows 36 that, by means to be described may be reciprocated horizontally inwardly and outwardly wherein one bellow is contracted and the opposed bellow 35 is extended. This is illustrated in FIGS. 1 and 2.

In order to shift the metallic piston closure plates 44 from right to left and back there is provided a piston rod 50. In the case of using dual bellows pumps 10 a single piston rod 50 will be preferably threaded into the piston closure plate 44 at the end of one bellows 36 and extend across to and be threaded into the opposite piston closure plate 44. Thus, with the FIG. 1 bellows 36 on the right side, the bellows 36 is contracted leaving a fluid space 52 between the fixed end closure 16 and the piston closure plate 44. On the other bellows 36 to the left, the bellows is pushed horizontally outward by the piston rod 50 so that the piston closure plate 44 butts the end closure 16 and the convolutions 38 of the bellows 36 are horizontally spread apart or extended.

Thus as one bellow 36 shifts so will the other bellows 36, reciprocating back and forth.

It has been found that when using the bellows pump 10 with such chemicals as hydrazide a basic substance that is acidic and can attack compounds such as glass and rubber the use of such metals as 300 stainless steel, nickel alloys and cobalt will be impervious to an attack. This would hold true for any fluid that is corrosive, caustic, acidic or toxic. As such the pump 10 has a lasting quality with little or no maintenance. This is because there are no O rings or other seals needed in the fluid flow area of the pump 10. Even the bearing 26 is of a material that could be attacked is isolated in by the inner end annular closure plate 24.

As will be seen the fluid is to be pumped into the annular spaces 54 and 52 so that it only comes in contact with the special metal as described above.

In addition to the special metal the pump 10 metal could be coated with commercially available plastic coatings that are impervious to the corrosive, caustic acidic or toxic fluids.

It should also be noted that with a bellows pump 10 as described with the lack of composite material seals the pump can withstand high pressures in the range of 1000 F. Having no such seals there can be no temperature or pressure problems.

In addition, as the only moving parts of the bellows pump 10 is the bellows 36 there is low stress on the pump and this will result in increased longevity.

Figure 4:
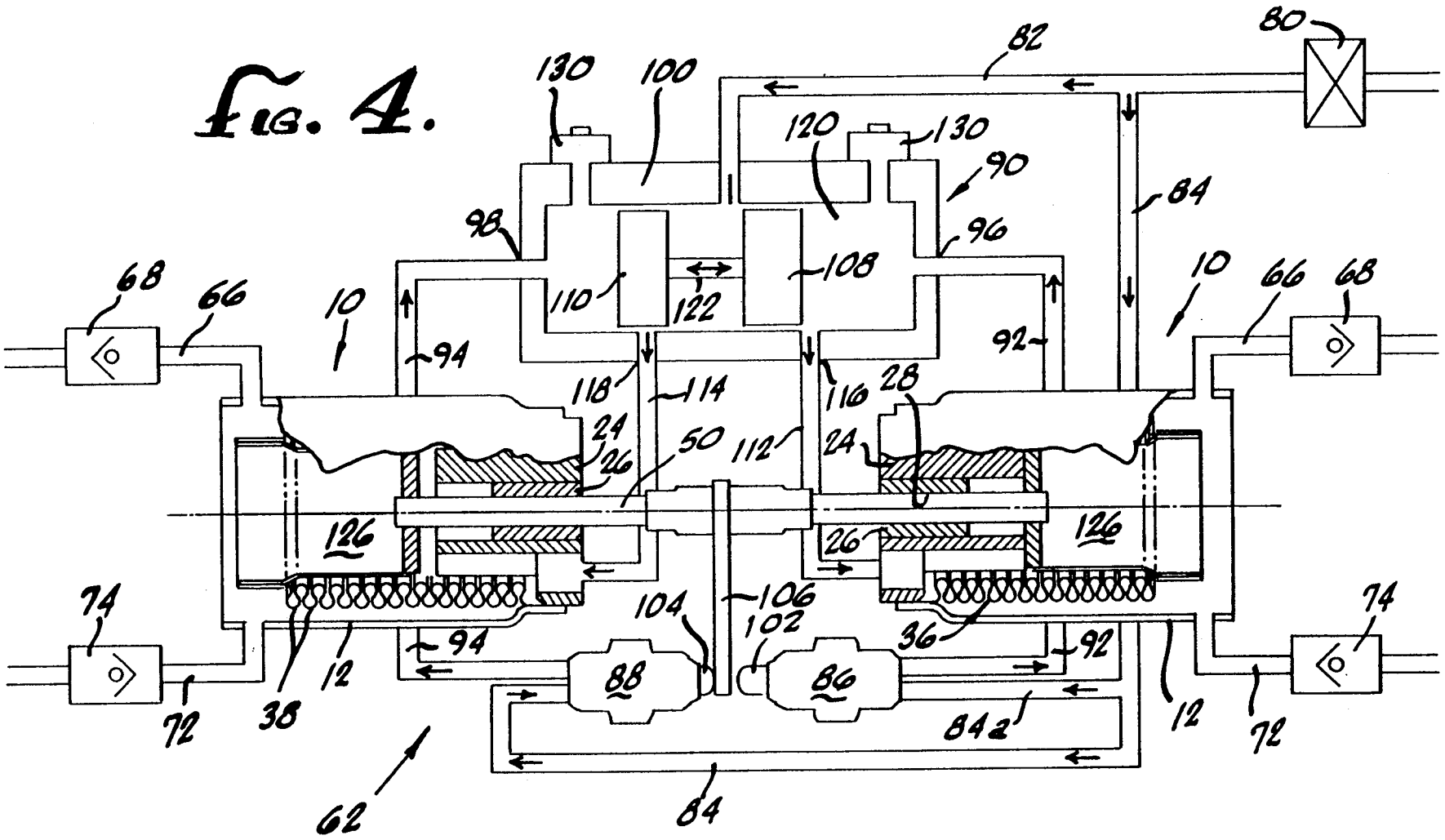
FIG. 4 is schematic view of the bellows pumps with apparatus to cause activation of the bellows pumps.

The pumping system as illustrated in FIGS. 1 and 2 and the schematic of FIG. 4 in generally designated 62. The components of the system may be mounted in the frame 20.

Figure 3:
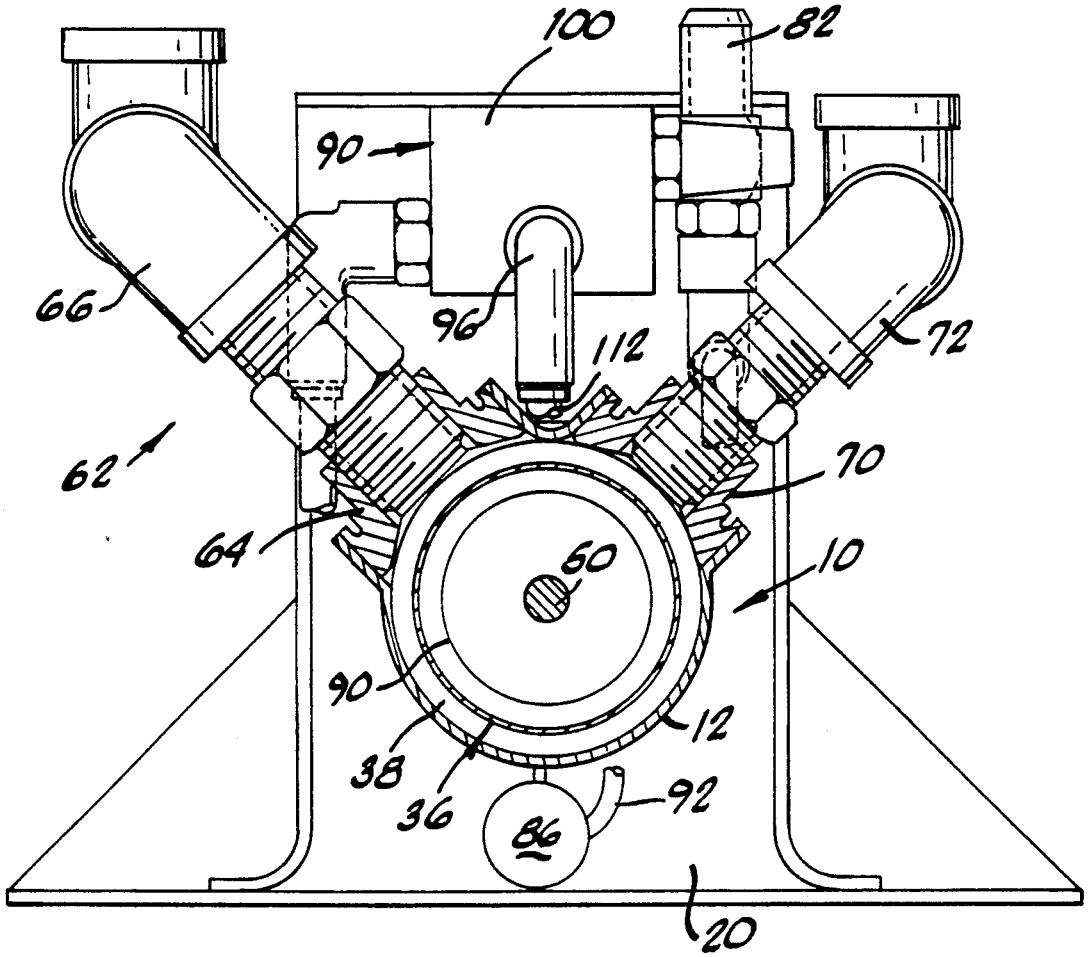
FIG. 3 is cross sectional view taken on line 3—3 of either FIGS. 1.

In FIGS. 1, 2 and 3 the casing 12 of each pump 10 is fitted with a fluid inlet coupling 64. Secured to the coupling 64 is a fluid inlet pipe 66. The pipe 66 will extend to a fluid reservoir (not shown) so that the fluids will be moved through pipes 66 to the pumps or pumps 10. Also the lines 66 may each contain commercially available check values 68, see FIG. 4, to prevent backflow of the pumped fluid.

Also each casing 10 includes a fluid outlet coupling 70. Secured to the coupling 70 is a fluid outlet or discharge pipe 72 that will meter the desired quality of fluid at the rate required. A check value 74 may also be provided.

In the system 62 where there are two pumps pumping fluid as in FIGS. 1 and 2, the outlet pipes 72 may each be joined to discharge the desired fluid into whatever medium is required. Also lines 66 may be joined together to the fluid source.

The illustrated system 62 is an air operated system, however hydraulics may be used without departing from the spirit of the invention.

In FIG. 4 there is an air pressure pump 80 that pumps air through lines 82 and 84. Line 82 runs to a commercially available momentary impulse five port spool valve 90. Line 84 passes to where it is split into line 84 and 84A. The line 84A terminates within a pressure limit switch 86 and line 84 terminates within a complementary pressure limit switch 88. The switches 86 and 88 are preferably mounted on mounting frame 20 in opposed horizontal relationship, see FIGS. 1 and 2.

Each switch 86 and 88 includes an exit line 92 and 94 respectively that runs to ports 96 and 98 in the casing 100 of spool valve 90.

The switches 86 and 88 each include a spring loaded plunger switch 102 and 104. The plunger switches 102 and 104 are activated by a trip rod 106 that is secured to the piston rod 50 and will move backwards and forwards as shown by the arrow with the movement of the rod 50.

The conventional switches 86 and 88 when open will allow air to pass from line 84 to 94 in the case of switch 88 and when in that position the plunger switch 102 of switch 86 is closed and air line 84A is closed off and air will not pass into line 92 and in turn into the spool valve 90.

The spool valve 90 is again a conventional type of valve that will include five ports, two of which are illustrated in FIG. 4 as cylinders 108 and 110. The other valving will open and close off lines 82, 92 and 94 and the bellows air lines 112 and 114 that pass from couplings 116 and 118.

The spool valve 90 operates by air pressure from lines 92 and 94 that will alternatively pass into the chamber 120 through ports 96 and 98 to shift cylinders 108 and 110, plus the others not shown, all of which are tied together by a tie rod 122. As can be 18 seen with switch 88 open, air moves through line 94 and port 98 into chamber 120 and pushes the cylinder or spool valving so that port 118 is closed and air will not pass through line 114 into connector coupling 124 (see FIG. 1) that communicates with the interior chamber 126 of bellows 36. Thus the bellows 36 is not flexed on the left side as it has reached the stop (against end plate 16) and expelled the fluid in the space 52 (see FIG. 2).

At the point of closure of the left bellows 36, the air line 112 is open allowing air to pass through coupling 128 (see FIG. 1 or 2) into the chamber 126 of the right bellows 36 to force it closed against end plate 16. Thus as it moves to the right the piston rod 50 moves contracting the left bellows 16 allowing fluid to enter the fluid space 52 from line 66 until it is filled to the desired quantity where the entire reciprocating process is repeated.

The spool valve 90 may also include adjustable air flow exhaust dampers 130 so that the timing of the shifting or reciprocating bellows 36 may be adjusted to control the time flowing of the fluid to be pumped.

The stroke of the bellows pump 10 will determine the quantity of fluid to be pumped. As an example in one operation where hydrazide is used to be injected into a water supply for purification of water at a nuclear power plant the requirement will usually be 0.014 gpm to be distributed over a five hours period per day. With the present invention the reciprocating metal bellows pumps 10 may be adjusted as to the intake stroke timing as well as a quantity of fluid passing into the annular space 5 and end space 52 for appropriate discharge through lines 72.

In the present invention preferably two bellows pumps 10 are illustrated with both intaking and discharging fluid. With the present setup the fluid intake and outlet or discharge lines 66 and 72 of one of the pumps 10 could be eliminated and it could act as a means to assist in the return of the other bellows for engaging in the actual pumping. The air system as described in the nonpumping bellows 10 assures the reciprocation necessary to accomplish the desired intent.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. A reciprocating metallic bellows pump adapted to receive a fluid in a measured quantity and discharge the same from the pump in a preselected period of time, said pump comprising:

a metallic casing including first and second end closures to seal the inside of said casing;

a hollow flexible formed metallic bellows having ends and also having walls of a common thickness, with one end affixed to said first end closure and said second end secured to a piston closure plate, said end and said piston closure plate being free to shift toward and from said fixed end by the contraction and expansion of said bellows due to external pressure means said bellows is a single piece of metal and includes more than four annular convolutions and each convolution separated from another by an annular web of a lesser diameter than said annular convolutions;

an inlet means to said casing capable of delivering said fluid to said bellows pump with contracted movement of said bellows;

an outlet means in said casing capable of discharging said delivered fluid when said bellows is expanded;

said metallic casing includes an annular wall and said bellows is annular and spaced from said annular wall wherein a space is created around said bellows and between said second end closure and said piston closure plate when said bellows is contracted; and said spaces are adapted to receive said fluid for discharging.

2. A reciprocating metallic bellows pump as defined in claim 1 wherein:

said first end includes a passage way therethrough communicating with said pressure means and the interior of said bellows wherein with the activation of said pressure means said bellows will be expanded toward said second end to expel any fluid within said spaces from said outlet means.

3. A reciprocating metallic bellows pump as defined in claim 2 wherein:

said pump includes no sealing means that are exposed to said fluid while in said pump.

4. A reciprocating metallic bellows pump as defined in claim 3 wherein:

the fluid to be pumped may be corrosive, caustic, acidic or toxic.

5. A reciprocating metallic bellows pump as defined in claim 4 wherein:

said external pressure means is a pressurized air source.

6. A reciprocating metallic bellows pump as defined in claim 4 wherein:

said external pressure means is a pressurized hydraulic source.

7. A reciprocating metallic bellow pump as defined in claim 1 wherein:

a second reciprocating metallic bellows pump is aligned with said first bellows pump;

a piston rod extends from one piston closure plate through each of said first end closures to said other piston closure plate wherein contraction of one flexible metal bellows will impart opposite expansion of said other flexible metal bellows.

8. A reciprocating metallic bellows pump combination as defined in claim 7 wherein:

said second reciprocating metallic bellows pump is assisted in contracted and expansion by said external pressure means; and said second reciprocating metallic bellows pump is capable of receiving and discharging fluid in opposite relationship to the receiving and discharging of fluid by said first reciprocating metallic bellows pump.

9. A system for pumping a fluids at high temperature at elevated pressures from an external source in preselected amounts and predetermined time comprising:

a pair of reciprocating metallic bellows pumps in end to end relationship, each adapted to receive said fluid and discharge the same, said pumps each including:

a metallic casing including a first and second end closure wherein in said end to end relationship the first end of one of said first bellows pumps is opposite said second end closure of said second bellows pump;

each pump includes a flexible hollow formed metallic resilient bellows having ends and also having walls of a common thickness, with one end affixed to said first end closure and said second end secured to a piston closure plate, said second end and said piston closure plate being free to shift toward and from said fixed end by the contraction and expansion of said bellows due to external pressure means said bellows is a single piece of metal and includes more than four annular convolutions and each convolution separated from another by an annular web of a lesser diameter than said annular convolutions;

an external fluid source communicating with the interior of said casing of at least one of said pumps to deliver fluid thereto with controlled movement of said bellows;

an outlet means in said casing of at least one of said pumps to discharge said delivered fluid when said bellows is expanded;

said external pressure means including an air source;

pressure limit switches to control air to said pump; and an air pressure actuated valve means to channel the air pressure to said bellows and said pressure limit switches whereby when one of said bellows is contracted to force out said fluid said other bellow is extended each of each of said metallic casings includes an annular wall and said bellows are annular and spaced from said annular wall wherein a space is created around said bellows and between said second end closure and said piston closure plate when said bellows are contracted; and said spaces are adapted to receive said fluid for discharging.

10. A system as defined in claim 9 wherein a piston rod extends from the piston closure plate of one of said pumps through the castings to said opposite piston closure plate to assist in opposite contracting and expanding movement of each of said bellows.

11. A system as defined in claim 10 wherein both of said pumps include means for said internal fluid source to communicate with the interior of each of said casings and both pumps will deliver fluid therein with alternating expanding of said bellows.

12. A system as defined in claim 11 wherein the metal of said casings and said bellows is imperious to corrosive, caustic, acidic or toxic fluids;

said pumps include no sealing means that are exposed to said fluid while in said pumps and said pumps may withstand temperatures up to 1000° F.

13. A system as defined in claim 12 wherein said system includes pressurized air source and valving means to meter air to said pumps for reciprocation; and a pair of limit switches having air passages connected to said valving means and each to one of said pumps to variably regulate air pressure to each of said bellows to shift each bellows where one is contracted and the other is extended; and a trip rod on said piston rod shiftable between said limited switches to activate and deactivate the switches to open and oppositely close the passages to said bellows to aid in the contraction and expansion.

14. A system as defined in claim 12 wherein said valving means includes adjustable air flow regulator means to control the timing of the expanding and contracting strokes of said bellow pumps.

* * * * *